US009464424B1

(12) United States Patent
Wiltshire

(10) Patent No.: US 9,464,424 B1
(45) Date of Patent: Oct. 11, 2016

(54) TOILET TOOL CLEANING SYSTEM

(71) Applicant: Michael Wiltshire, Jacksonville, FL (US)

(72) Inventor: Michael Wiltshire, Jacksonville, FL (US)

( * ) Notice: Subject to any disclaimer, the term of this patent is extended or adjusted under 35 U.S.C. 154(b) by 265 days.

(21) Appl. No.: 14/244,894

(22) Filed: Apr. 3, 2014

Related U.S. Application Data

(60) Provisional application No. 61/808,305, filed on Apr. 4, 2013.

(51) Int. Cl.
*E03D 9/00* (2006.01)
*E03C 1/308* (2006.01)
*A47K 11/10* (2006.01)

(52) U.S. Cl.
CPC ..... *E03D 9/005* (2013.01); *A47K 11/10* (2013.01); *E03C 1/308* (2013.01)

(58) Field of Classification Search
CPC ..... E03D 9/00; E03D 9/005; E03D 9/06; A47K 11/10; A47K 17/00; E03C 1/308; A46B 17/06
USPC ..... 4/321, 341, 661; 206/209, 361, 581; 321/31, 206; 422/300, 301
See application file for complete search history.

(56) References Cited

U.S. PATENT DOCUMENTS 2,834,026 A * 5/1958 Kronish ..... A61G 9/02 134/152
2,918,925 A * 12/1959 Dopler ..... F28G 1/166 118/316
5,259,406 A * 11/1993 Hofmann ..... A46B 17/06 134/103.2
5,836,322 A * 11/1998 Borger ..... A47K 11/10 134/183
2004/0159330 A1* 8/2004 Anemone ..... A61L 2/18 134/1
2009/0260998 A1* 10/2009 Davidson ..... A47K 17/00 206/207

FOREIGN PATENT DOCUMENTS

IT EP 1712172 A1 * 10/2006 ..... A47K 11/10
IT WO 2011101883 A1 * 8/2011 ..... A47K 17/00

* cited by examiner

*Primary Examiner* — Paul R Durand
*Assistant Examiner* — William R Klotz
(74) *Attorney, Agent, or Firm* — Mark Young, P.A.

(57) ABSTRACT

A toilet tool cleansing system employs a mixing eductor that disperses a disinfectant solution into a water stream that is sprayed onto the tool and thereafter collected and discharged into a toilet via a drain eductor. The cleansing system includes plumbing and a valve adapted to be in fluid communication with an existing water supply source. A housing receives the toilet tool. The housing has at least one spray nozzle in fluid communication with the mixing eductor for dispensing the water and disinfectant on the tool. The drain eductor propels waste liquids from the system into a toilet bowl.

18 Claims, 13 Drawing Sheets

TOILET TOOL CLEANING SYSTEM

RELATED APPLICATION

This application is a nonprovisional of and claims the benefit of priority of U.S. Provisional Application 61/808,305 filed 4 Apr. 2013, the entire contents of which are incorporated herein by this reference and made a part hereof.

FIELD OF THE INVENTION

This invention relates generally to storage and cleaning devices and, more particularly, to a system for storing and cleaning a toilet tool.

BACKGROUND

Toilet bowl plungers for flushing a toilet bowl to remove obstructions and clogging are well known. Such obstructions prevent water in the bowl from being flushed from the toilet bowl through the drain pipes into the sewage system.

Similarly, toilet bowl brushes for cleaning the inside of a toilet bowl are well known. Many such brushes are non-disposable and intended for repeated use.

Typically, plungers include an elongated handle with an inverted cup-shaped plunger portion, generally of rubber or other resilient material, connected to an end of the handle. In order to plunge a clogged toilet bowl, the plunger portion is placed over the opening at the bottom of the bowl and pushed downwardly. The walls of the plunger portion collapse and force air under pressure through the opening. The plunger handle is pulled upwardly to release the plunger portion and restore it to its initial position. This applied suction usually dislodges any obstructions in the bowl and the bowl trap.

Likewise, a toilet brush includes an elongated handle. A brush or sponge or other cleaning element is attached to one end of the elongated handle.

Each tool includes an element or portion that comes in contact with water and residue in the toilet bowl. The plunger portion or brush portion, and the lower part of the plunger or brush handle, come into contact with unsanitary material in the bowl. It is preferred if such tools can be stored in close proximity to the toilet, so that they are available when needed. However, it is difficult to store, in a sanitary and aesthetically pleasing manner, a dripping wet toilet tool.

Accordingly, a need remains for a toilet tool storage and cleansing device in order to overcome at least one prior art shortcoming. The invention is directed to overcoming one or more of the problems and solving one or more of the needs as set forth above.

SUMMARY OF THE INVENTION

To solve one or more of the problems set forth above, in an exemplary implementation of the invention, a toilet tool cleaning system rinses and to some extent disinfects a toilet plunger or brush after it is used to unclog or clean a toilet. The toilet tool is rinsed with water or a mixture of water and a liquid disinfectant that removes undesirable bacteria and residue from interior and exterior surfaces of the toilet tool. Then, the waste is drained directly into the toilet via the drain line. The system allows guests to access, use and disinfect a toilet tool thereby avoiding possible embarrassment by not having to notify the host about a clogged or soiled toilet.

In a non-limiting exemplary embodiment, the system includes a frusto-conical housing containing at least one spray nozzle and preferably two or more spray nozzles. In an embodiment with two nozzles, one of the spray nozzles is positioned adjacent to and underside of the plunger cup or brush of the tool. The other spray nozzle may be positioned adjacent to a topside of the plunger cup or brush; mimicking a shower head. The interior cavity of housing includes ledges to support a plunger at a slightly raised and substantially stable position during cleansing procedures. Additionally, the housing includes a drain port located at the bottom of a funnel-like receptacle. A drain line extends from the drain port to a toilet, for draining the waste away from the housing. A drain eductor propels waste to the toilet.

The frusto-conical housing includes an access door coupled with a hinge. The door may be pivoted between open and closed positions. When the door is in an open position, a tool may be placed in or removed from the housing. When the door is in a closed position, the tool is contained in the housing for cleaning and/or storage.

The system may be wall-mounted or recessed partially into a wall. Anchoring the system to a wall may be accomplished with conventional fasteners. To recess the system into a wall, an opening that outlines the shape of the system may be cutout from the wall. Then screws may be inserted into holes provided in anchor flaps attached to the housing exterior. The screws may be secured to the wall and thereby support the system at a substantially stable position.

In a non-limiting exemplary embodiment, a mixing eductor having a venturi design enables efficient introduction of disinfectant solution to the cleaning water. A stream of flowing water creates a low pressure area that draws disinfectant solution into the stream. The disinfectant is contained in a replaceable or refillable bottle. The mixture of disinfectant and water is sprayed from the nozzles onto the plunger cup or brush.

A manual valve selectively permits pressurized clean water to flow from an external water supply source, such as a water supply line in a bathroom, to plumbing that supplies liquid to the nozzles. A Tee-coupling may connect a water inlet line to the water supply line.

BRIEF DESCRIPTION OF THE DRAWINGS

The foregoing and other aspects, objects, features and advantages of the invention will become better understood with reference to the following description, appended claims, and accompanying drawings, where:

Those skilled in the art will appreciate that the figures are not intended to be drawn to any particular scale; nor are the figures intended to illustrate every embodiment of the invention. The invention is not limited to the exemplary embodiments depicted in the figures or the specific components, configurations, shapes, relative sizes, ornamental aspects or proportions as shown in the figures.

DETAILED DESCRIPTION

Figure 1:
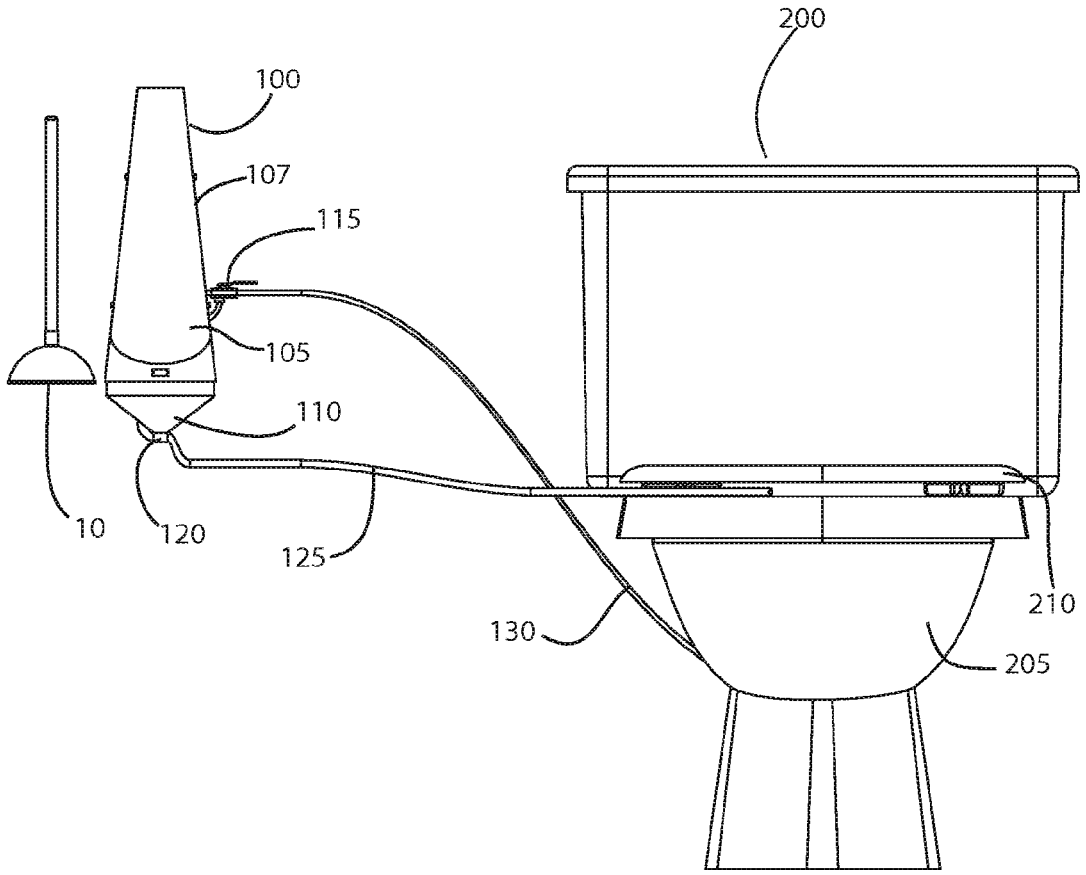
FIG. 1 conceptually illustrates an exemplary toilet tool cleaning system operably coupled to a toilet water supply according to principles of the invention.

FIG. 1 illustrates a toilet tool cleaning system 100 operably coupled to a toilet 200. The system 100 includes a door 105 that opens to provide access to an interior compartment in which a toilet tool 10 may be stored and cleaned. When closed (as shown), the door 105 provides a drip-proof seal. The toilet tool may be a plunger 10, toilet bowl brush or any other tool that comes in contact with toilet bowl water. If the tool 10 is taller than the container, a hole may be formed in the container top to allow passage of the handle.

Water is supplied from a supply line 130 through a manual valve 115 to one or more spray nozzles in the interior compartment. By way of example and not limitation, the valve 115 may comprise a ball valve (e.g., a three-position ball valve). Opening the valve 115 allows water to flow into the system for either cleaning a stored tool or for evacuating waste liquids. Closing the valve 115 stops the flow of water to the system.

As described below, the system includes an eductor in which supplied water flows through a path in fluid communication with a cleaning solution supply. The water and cleanser solution is sprayed on the working end of the toilet tool.

A funnel-shaped receptacle 110 collects the water, cleanser and residue from the tool and directs the substances to an outlet 120 coupled to a drain line 125. The drain line 125 extends to the bowl 205 of the toilet 200. The line 125 is thin enough to extend through the space between the seat 210 and the bowl 205. In one embodiment, the substances flow into the bowl 205 of the toilet 200 under the influence of gravity, as the system 100 may be positioned at a height above the bowl height. In such an embodiment, the system may be mounted to a wall or supported on a stand at an elevated height.

However, In a particular preferred embodiment, the drain port includes an eductor, which is fed by water from the valve 115. In this embodiment, the valve 115 is a three way valve, having an off position that prevents the flow of water through the valve, a first on position that feeds the eductor for the cleaning solution as described below, and a second on position that feeds the eductor for the drainage. In this particular preferred embodiment, the system does not depend upon gravity for drainage and may be positioned below the height of the toilet bowl. Rather suction from the water flowing past the drain port to the drainage line will draw accumulated waste liquids and residue from the receptacle 110 through the drain port into the bowl.

In yet another embodiment, a solenoid valve with a float switch may be provided to control the flow of substances from the receptacle 110 through the outlet 120 through the drain line 125 into the bowl 205. In such embodiment, the accumulated liquids in the receptacle 110 trigger the float switch which allows flow of water to the drain eductor for drainage to the toilet bowl.

Figure 2:
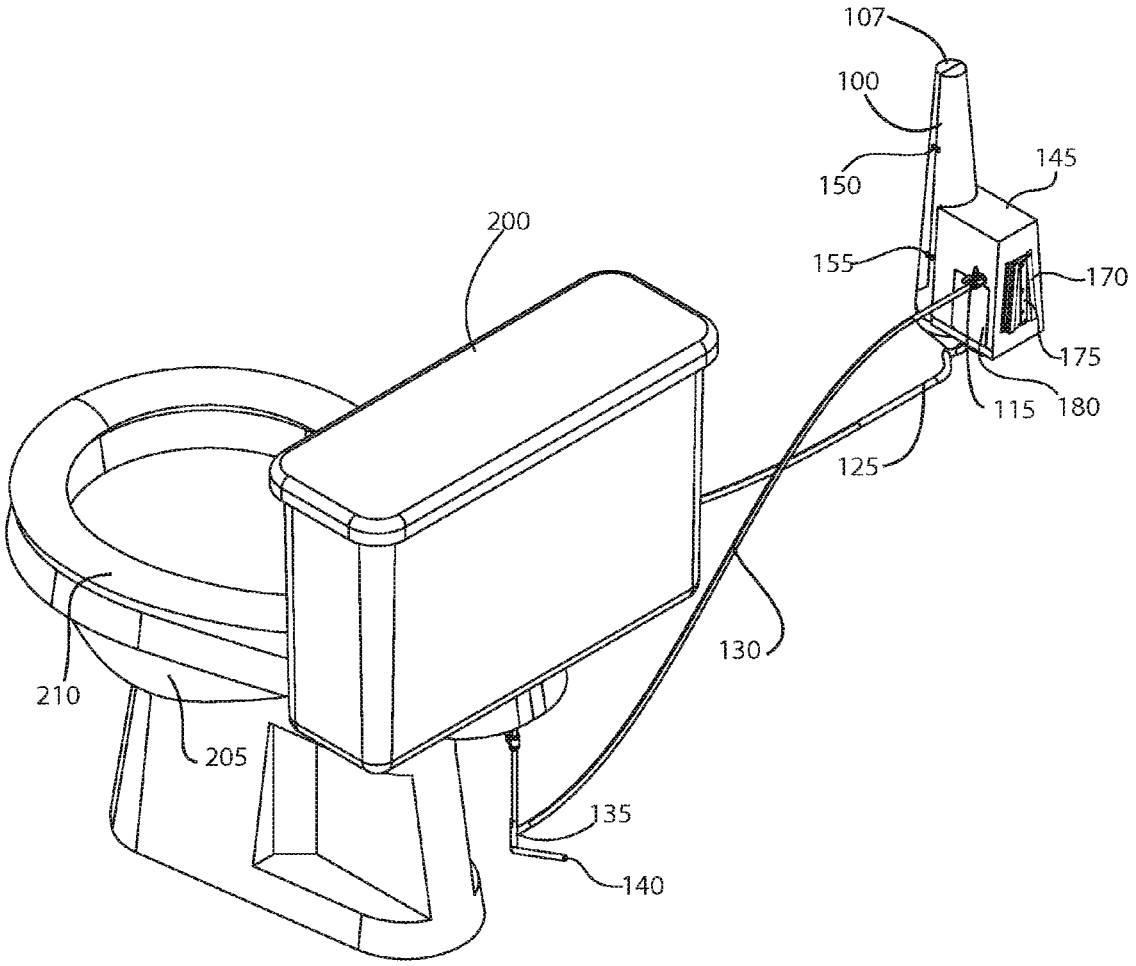
FIG. 2 provides a back perspective view of the exemplary toilet tool cleaning system operably coupled to a toilet water supply according to principles of the invention.

FIG. 2 provides a back view of the exemplary system. A water supply line 140 for the toilet 200 is equipped with a tee-fitting 135 coupled with the water supply line 130 for the system 100. An attached housing 145 with a removable access panel 180 contains plumbing and a cleaning solution supply. A plurality of snap fit connections 150, 155 hold the door 105 in a closed position, until the door 105 is urged open. The back of the housing 145 may attach to a wall or other vertical support structure using angled mounting flanges 170 and a wall mounting pad 175.

Figure 3:
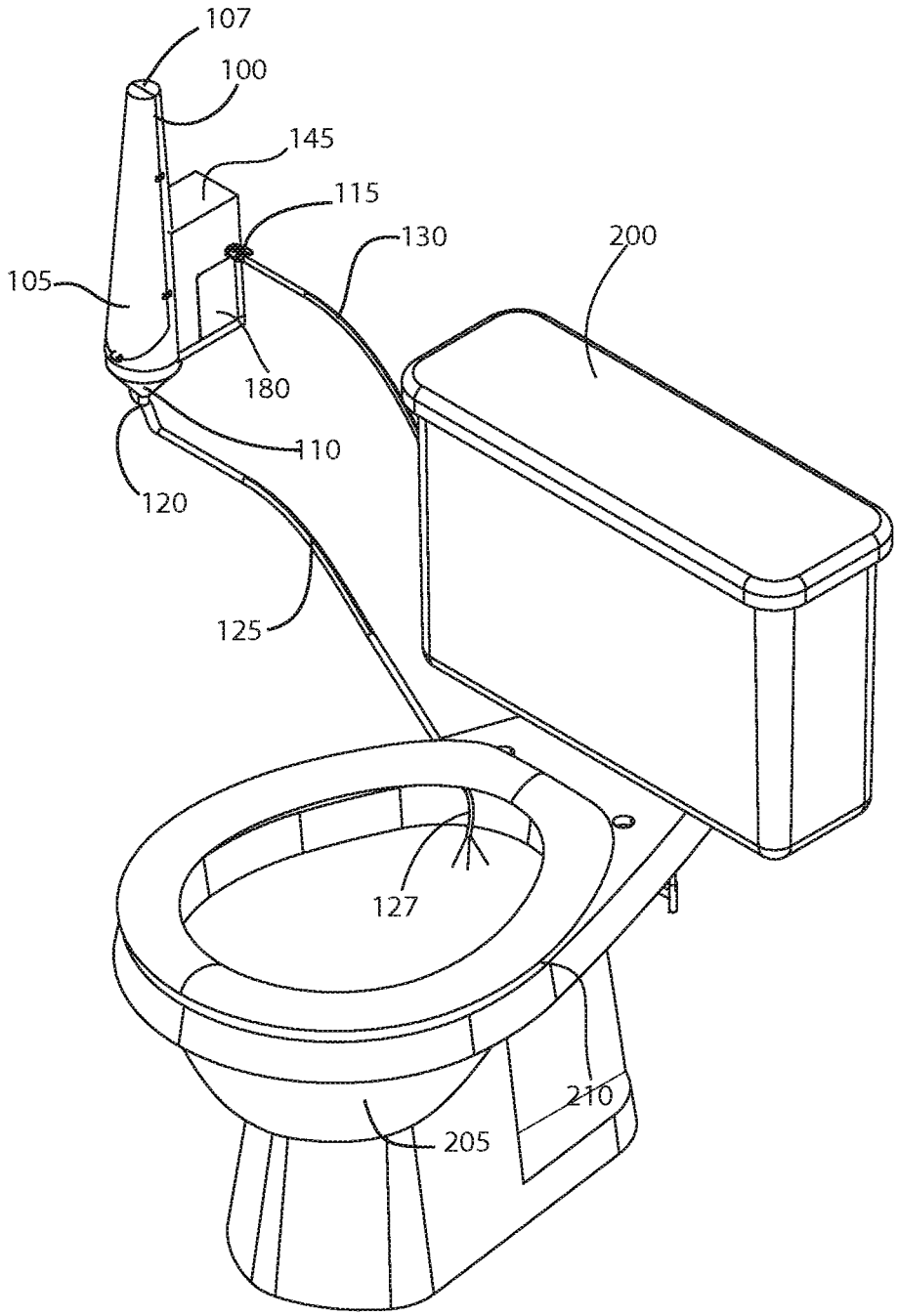
FIG. 3 provides a front perspective view of the exemplary toilet tool cleaning system operably coupled to a toilet water supply according to principles of the invention.

In FIG. 3, the terminus of the drain line 125 is shown expelling effluent into the bowl 205. Again, in an exemplary embodiment the flow into the toilet bowl is induced by gravity. Thus, the system 100 is positioned higher than the bowl 205.

Figure 4:
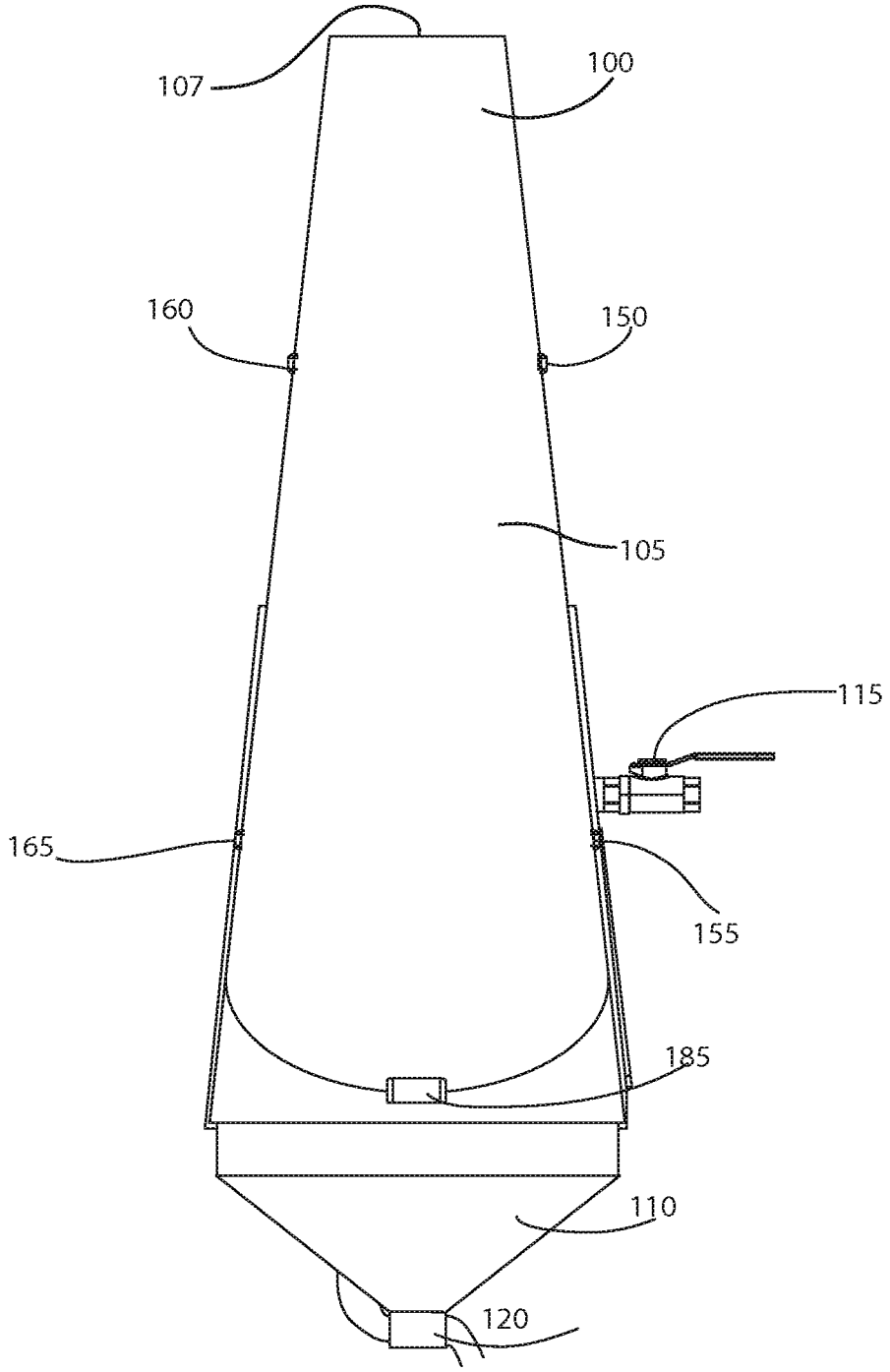
FIG. 4 conceptually illustrates an exemplary toilet tool cleaning system apart from a toilet according to principles of the invention.

In FIG. 4, a hinge 185 for attaching the door 105 and snap fit connections 150, 155, 160, 165 are shown. The door pivots open and closed using the hinge 185. The invention is not limited to the illustrated hinge 185 or to any form of hinge. Rather, any means for temporarily opening the door may be utilized without departing from the invention.

Figure 5:
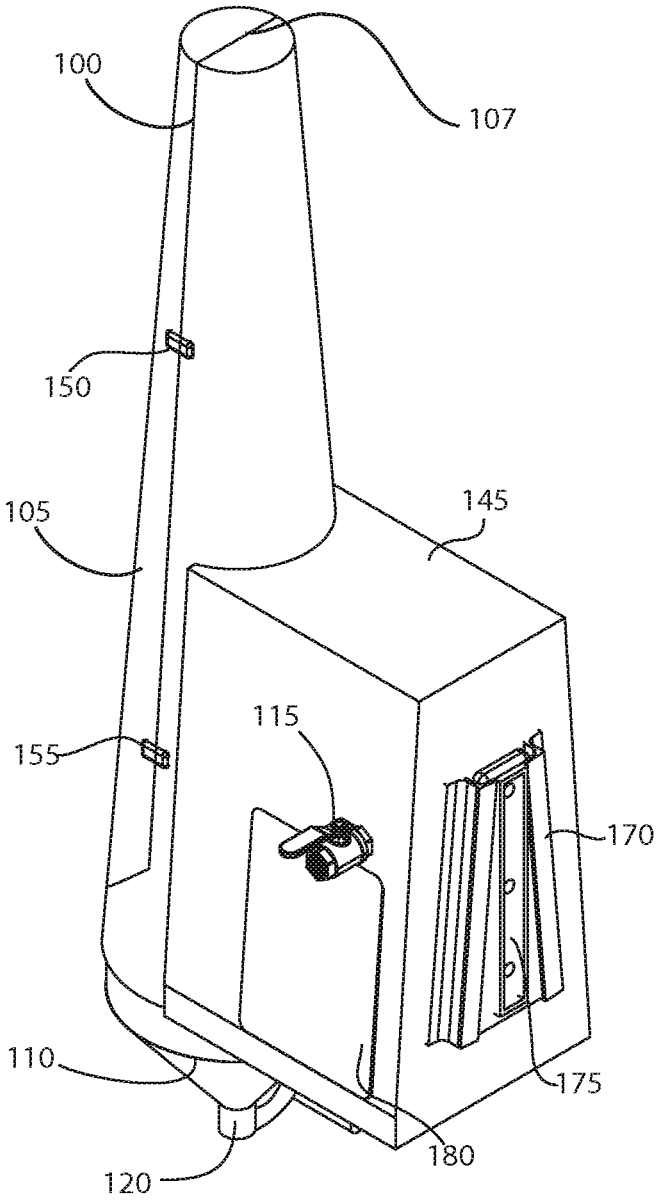
FIG. 5 provides a back perspective view of an exemplary toilet tool cleaning system apart from a toilet according to principles of the invention.

In FIG. 5, the access panel 180 and wall mount are more clearly shown. The wall mount comprises angled mounting flanges 170 and a wall mounting pad 175. The wall mounting pad 175 may be attached to a wall. The flanges are attached to the back of the housing 145 of the system 100. The flanges 170 are fixed to the back of the housing 145 at an angle relative to each other. The distance between the flanges is greater towards the bottom of the flanges. The space between the flanges 170 is sized and shaped to snugly receive the engageable portion of the wall mounting pad 175.

Figure 6:
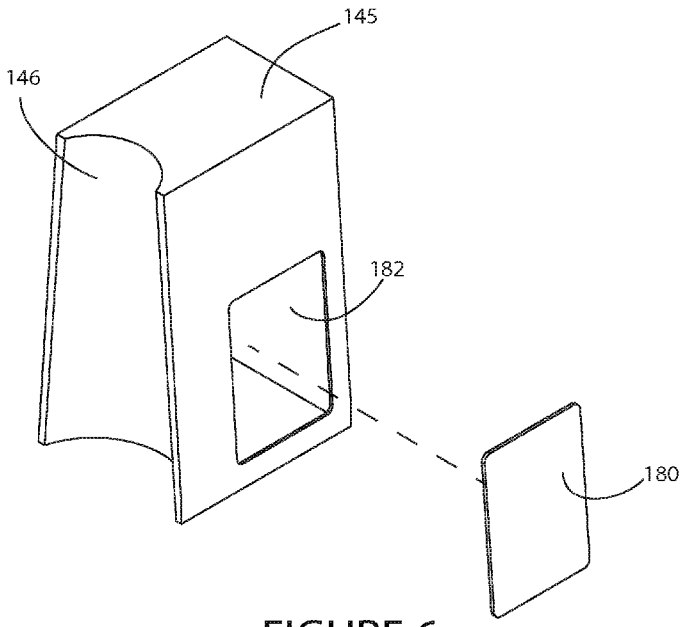
FIG. 6 provides a perspective view of an exemplary housing with a removed access panel for an exemplary toilet tool cleaning system apart from a toilet according to principles of the invention.

In FIG. 6, an exemplary housing 145 is shown. The housing 145, which encloses the cleaner solution and plumbing, may have any of various suitable shapes and sizes. In the exemplary embodiment a removable access panel 180 provides access to the interior compartment 182 defined by the housing. The front 146 of the housing 145 is shaped to securely abut the corresponding frusto-conical toilet tool container 107 of the system 100. The housing 145 is preferably permanently attached to the frusto-conical toilet tool container 107 of the system 100.

Figure 7:
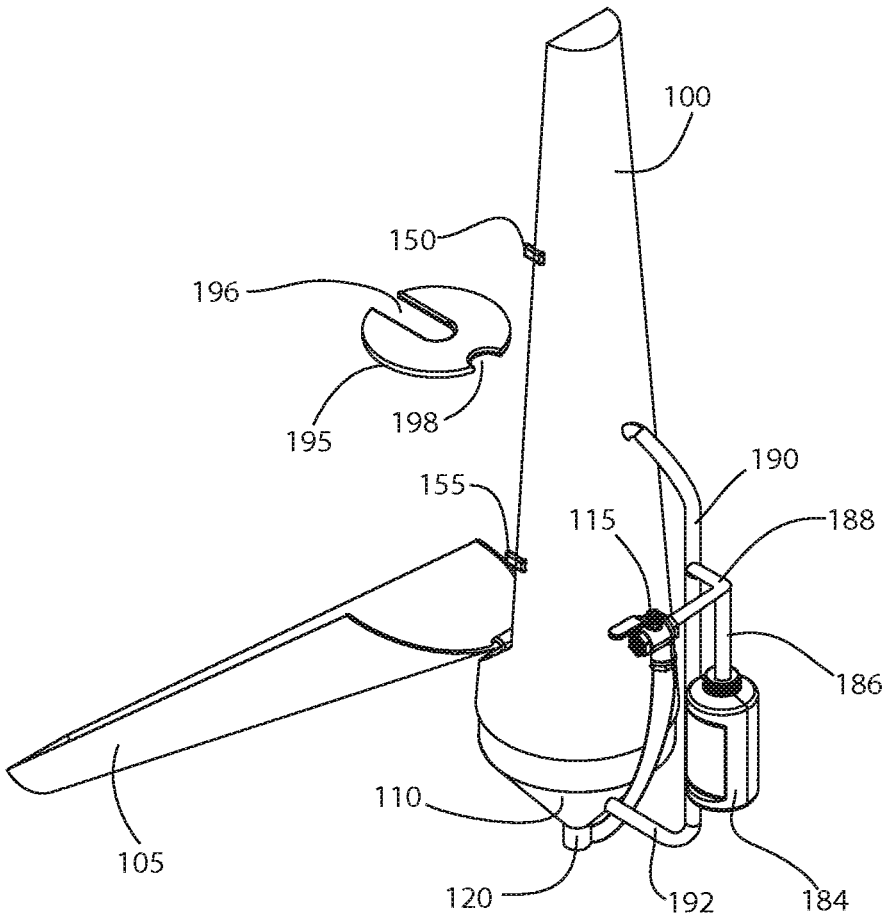
FIG. 7 provides a back perspective view of an exemplary toilet tool cleaning system in an open configuration, apart from a toilet, with a support disc removed, according to principles of the invention.

FIG. 7 provides a perspective view of the system, without the housing 145, to reveal the housed plumbing 184, 186, 188, 190, 192 and a cleaner solution bottle 184. A threaded fitting defines a port (e.g., an eductor port) to which a threaded neck of the bottle attaches. The port is located between the valve and the nozzle in fluid communication with the plumbing that supplies the water. Water enters through the valve 115. At side outlet elbow 188, the cleaner solution 184 is in fluid communication with entering water via cleaner outlet line 186. The Bernoulli effect from the flow of water causes suction through the cleaner outlet line 186. The cleaner outlet line 186 extends into the cleaner solution bottle 184 towards the bottom of the bottle 184. Cleaner solution is sucked from the bottle 184 via the cleaner outlet line 186 and introduced into the water stream provided to nozzles. An upper nozzle 102 receives the water and cleaner solution mixture via upper supply line 190. A lower nozzle 104 receives the water and cleaner solution mixture via lower supply line 192.

A support disc 195 is also shown in FIG. 7. The support disc snaps into the frusto-conical container 107 of the system 100. A slot 196 allows a handle of a toilet tool 10 to extend through the disc 195. A notch 198 allows an upper nozzle 102 to extend through the disc 195. If the upper nozzle 102 is positioned below the disc, the notch 198 is unnecessary.

Figure 8:
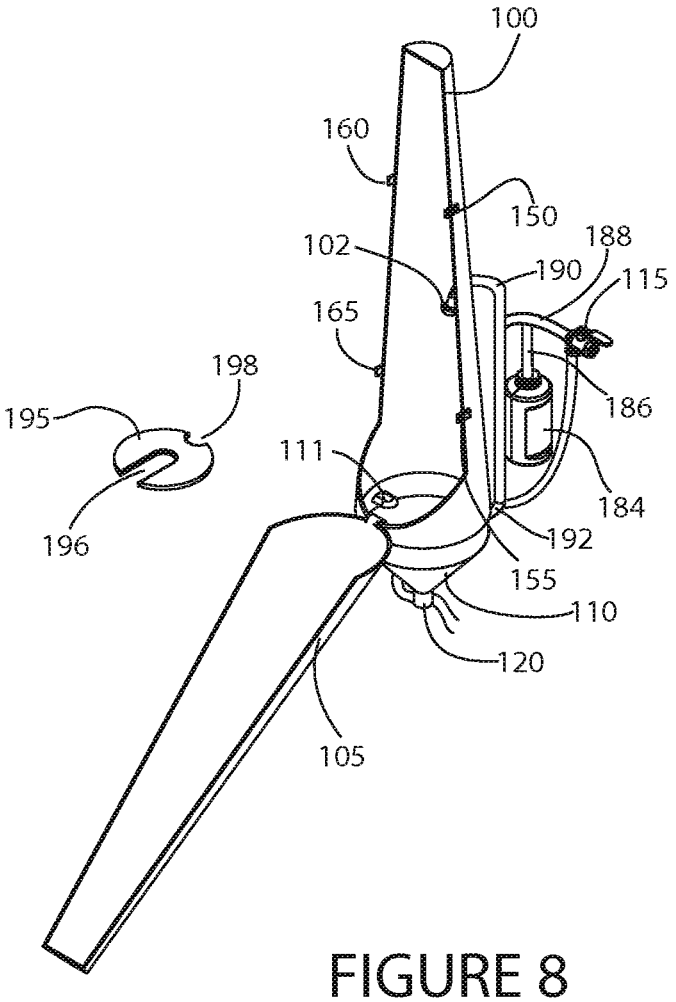
FIG. 8 provides a front perspective view of an exemplary toilet tool cleaning system in an open configuration, apart from a toilet, with a support disc removed, according to principles of the invention.
Figure 9:
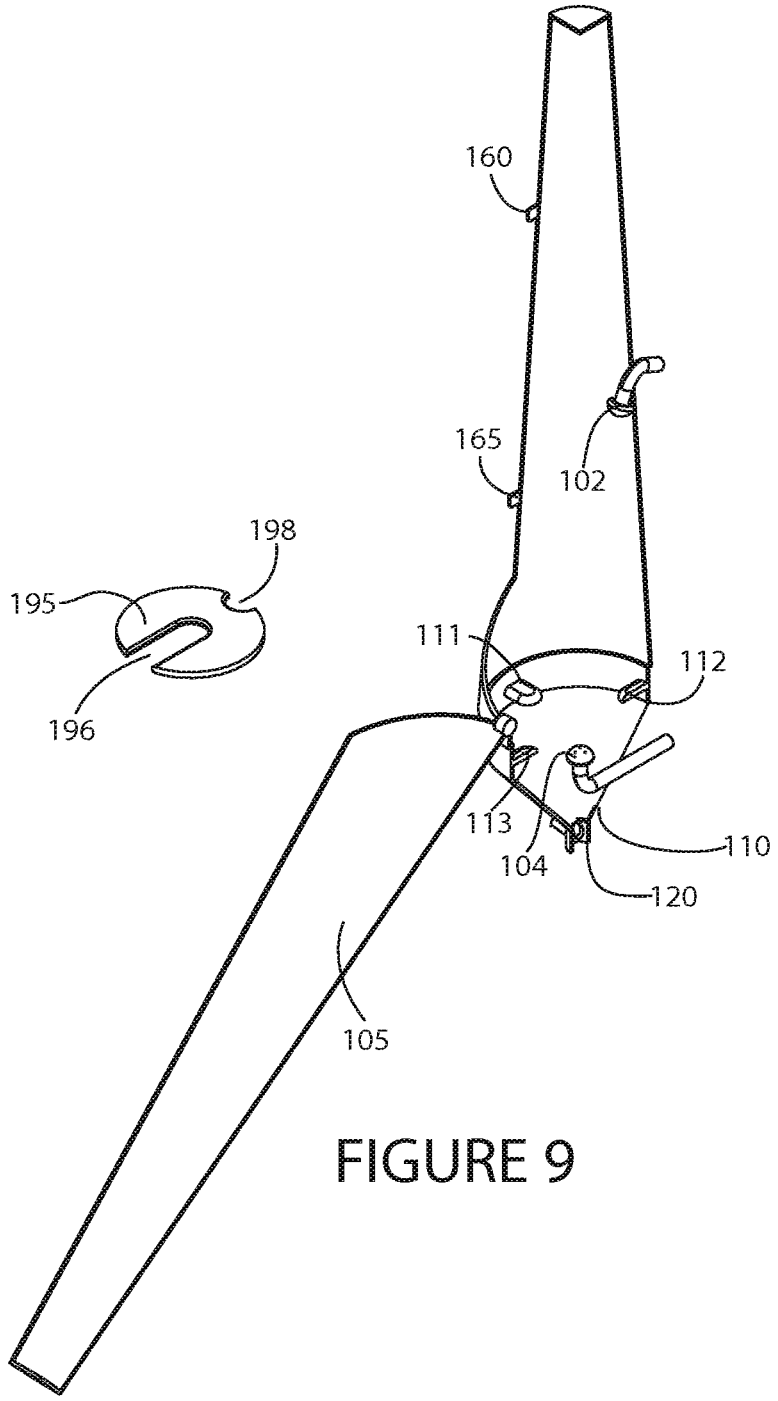
FIG. 9 provides a front perspective view of a section of an exemplary toilet tool cleaning system in an open configuration, apart from a toilet, with a support disc removed, according to principles of the invention.

In the perspective view of FIG. 8 and the cutaway perspective view of FIG. 9, the upper nozzle 102 is partially visible. The upper nozzle sprays cleaning fluid (e.g., water or water with cleaner) downwardly onto the working portion (e.g., deformable plunger head) of the toilet tool 10. The lower nozzle sprays cleaning fluid (e.g., water or water with cleaner) upwardly onto the working portion (e.g., deformable plunger head) of the toilet tool 10. The head of the toilet tool 10 is kept elevated above the receptacle 110 by a plurality of spacers 111, 112, 113. This prevents a plunger from forming a seal that would prevent drainage of fluid sprayed from the upper nozzle 102. In FIG. 5, the access panel 180 and wall mount are more clearly shown. The wall mount comprises angled mounting flanges 170 and a wall mounting pad 175. The wall mounting pad 175 may be attached to a wall. The flanges are attached to the back of the housing 145 of the system 100.

Figure 10:
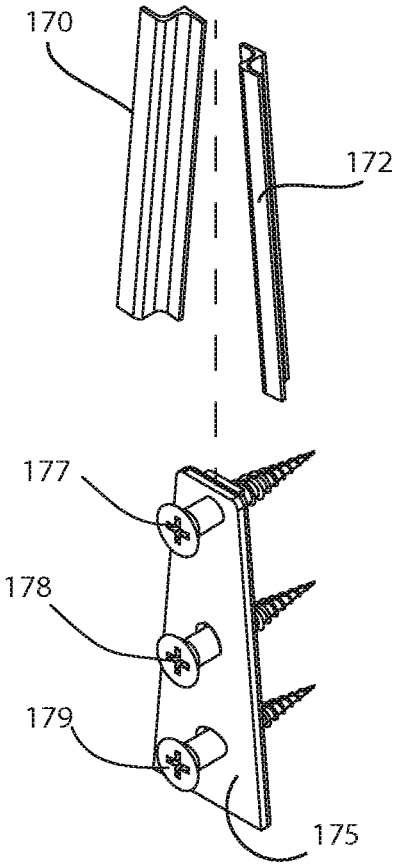
FIG. 10 provides a first perspective view of an exemplary wall mount for an exemplary toilet tool cleaning system according to principles of the invention.
Figure 11:
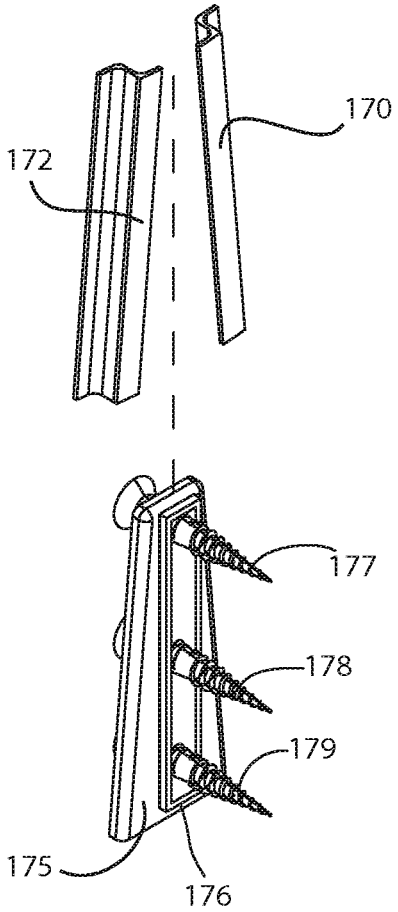
FIG. 11 provides a second perspective view of an exemplary wall mount for an exemplary toilet tool cleaning system according to principles of the invention.
Figure 12:
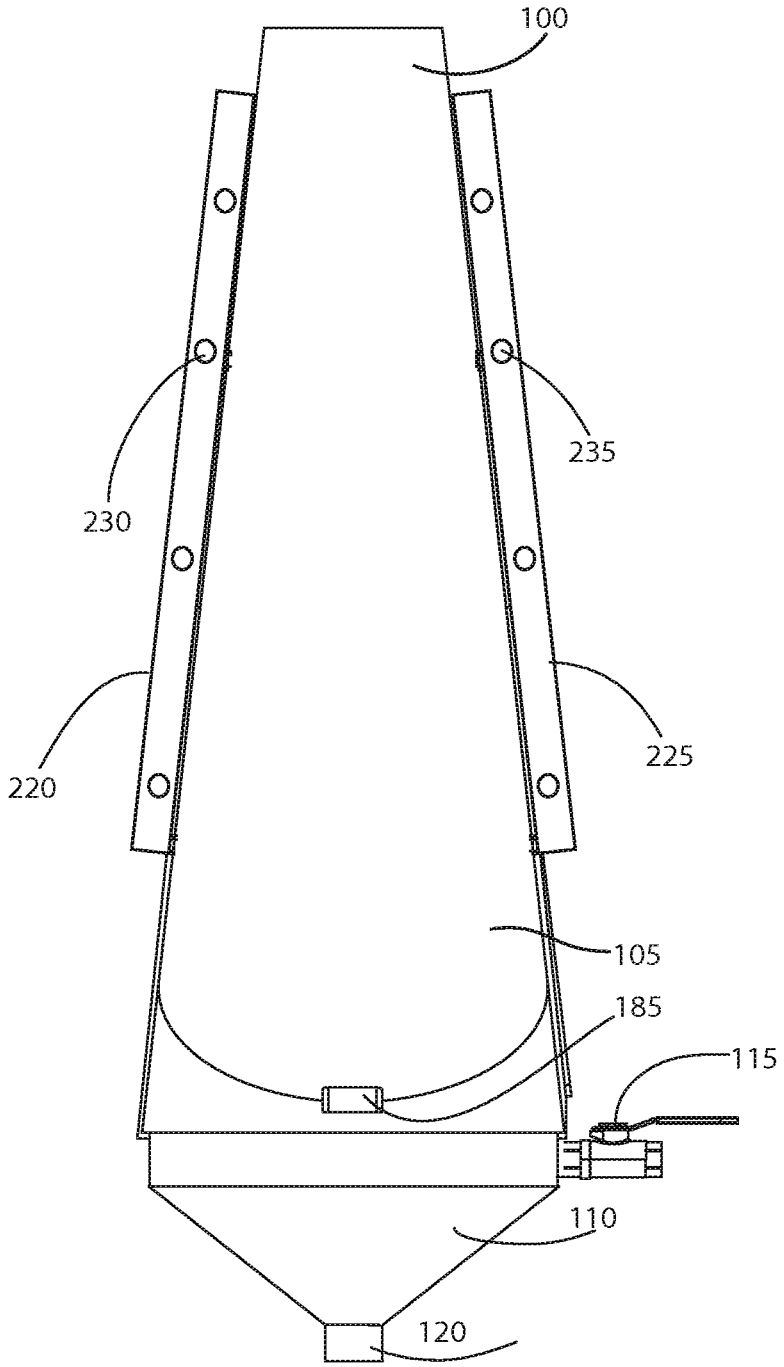
FIG. 12 conceptually illustrates an exemplary toilet tool cleaning system apart from a toilet with wall mounting flanges according to principles of the invention.

FIGS. 10 and 11 provide perspective views of a wall mount. Any wall mounting elements suitable for attaching the system 100 to a wall adjacent to a toilet at an elevated height, may be used. Examples of such other mounts include shelves, hooks, cables, nails, screws, and any other mounts suitable for attaching pictures frames or cabinets to a wall. The mount shown in the figures is a nonlimiting example of one possible mount. The flanges 170, 172 are fixed to the back of the housing 145 at an angle relative to each other.

The distance between the flanges 170, 172 is greater towards the bottom of the flanges. The space between the flanges 170 is sized, tapered and shaped to snugly receive the engageable portion of the wall mounting pad 175. A spacer 176 maintains a space between the wall and the pad 175 to allow the engaging portions of the flanges 170, 172 to fit between the pad 175 and the wall. Without the spacer 176, the pad would be flush against the wall providing nothing to grip. A plurality of flush mount screws extend through holes in the pad for attachment to a wall. The screws are aligned so that they may be screwed into an available vertical wall stud.

In yet another embodiment, side flanges 220, 225 are provided for an alternative form of wall mounting. The system may be mounted in a recess in a wall. The recess may be shaped and sized to receive the back end of the system. The flanges may mount against the surface of the wall. Each flange 220, 225 includes a plurality of screw holes for mounting. After mounting, the flanges may be visible or concealed using a wall covering such as joint compound. In such an embodiment, an access panel may be provided in the frusto-conical housing 107 to provide access to the disinfectant bottle for replenishment or replacement. Other means of wall mounting, including shelves, straps, hooks and the like may be utilized without departing from the scope of the invention.

As discussed above, a preferred exemplary embodiment includes two eductors. One eductor, an input eductor, draws cleaning liquid into the water stream supplied to the spray nozzles for cleaning the toilet tool. The other eductor draws liquid wastewater and entrained matter through the drain port and propels the substances into the toilet bowl. Using the drain eductor avoids the need to use a mechanical pump or gravity to drain the device. Thus, with a drain eductor, the device may be positioned at a height lower than the toilet bowl.

Figure 13:
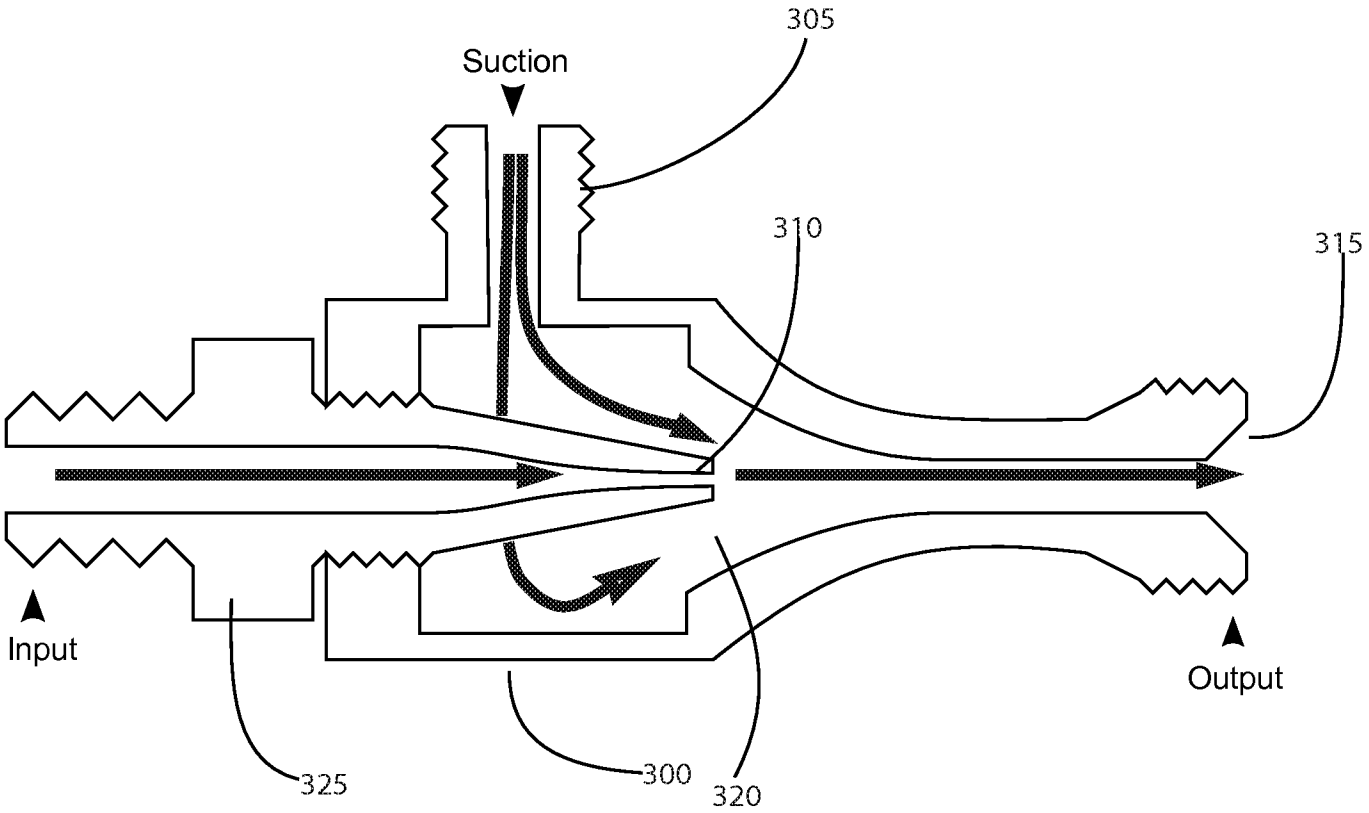
FIG. 13 is a high level schematic of a nonlimiting example of an eductor, for use as an input eductor (aka "mixing eductor") or as a drain eductor, in accordance with the principles of the invention.

With reference now to FIG. 13, a high level schematic provides a nonlimiting example of an eductor 300, for use as an input eductor or drain eductor, in accordance with the principles of the invention. The exemplary eductor 300 includes a water inlet 325 through which water flows. A nozzle 310 leads to a chamber 320 or venturi of the eductor. A low pressure area is formed in the venturi 320, which will draw liquids, air, and any free floating materials in the drawn fluids, from the suction inlet 305 through the venturi 320 to the outlet 315 of the eductor 300. In other words, the low pressure area sucks flowable substances from within the venturi to a downstream location.

In the input eductor, the suction inlet 305 leads to the cleaner bottle 184, while the outlet 315 leads to the nozzles 102, 104, and the water inlet is coupled to the water supply line 130 via three-way valve 115. Thus, when water is supplied to the water inlet 325, cleaner liquid is drawn through the suction inlet 305, mixes with the water and exits through the outlet 315, which are fluidly coupled to the nozzles 102, 104.

In the drain eductor, the suction inlet 305 leads to or constitutes the drain port, while the outlet 315 leads to the drain line 125, and the water inlet is coupled to the water supply line 130 via three-way valve 115. Thus, when water is supplied to the water inlet 325, waste liquid and floating residue is drawn through the suction inlet 305, mixes with the water and exits through the outlet 315, from where they are propelled through the drain line 125 into the toilet bowl 205.

Figure 14:
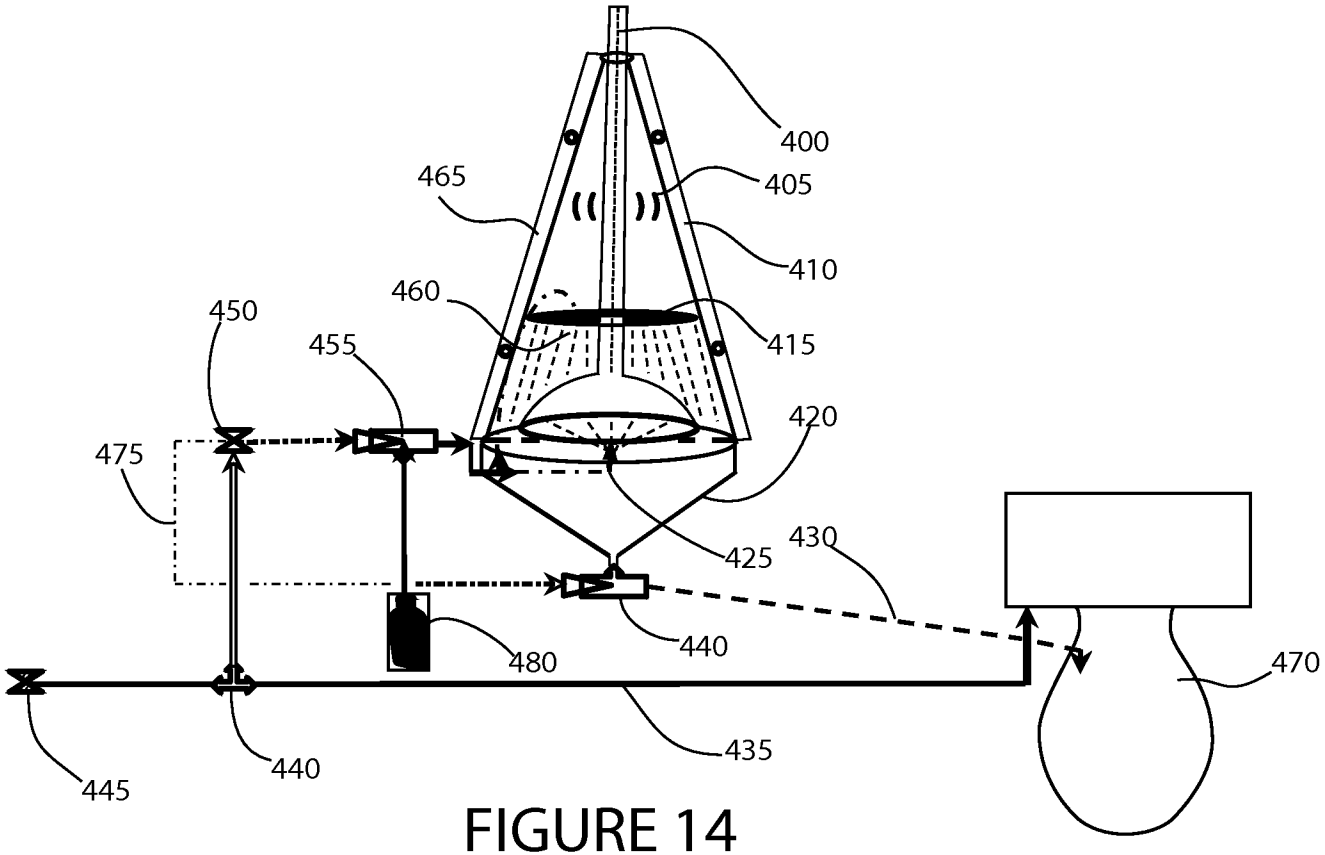
FIG. 14 provides a high level schematic conceptually illustrating components of a nonlimiting exemplary embodiment of a toilet tool cleaning system according to principles of the invention.

Referring now to FIG. 14, a high level schematic illustrates components of a nonlimiting exemplary embodiment of the present invention. A plunger 400 is shown in the housing 405, which may include air vents. Mounting flanges 410, 465 are provided for wall attachment. A support disc 415 positions the handle of of the plunger 400, and may include an integrated or attached upper nozzle 460 aimed downwardly towards the cup of the plunger 400. The receptacle 420 collects waste. A lower nozzle 425 is aimed upwardly towards the cup of the plunger 400. A drain eductor 440 facilitates draining of liquid waste accumulated in the receptacle 420. The drainage flows to the toilet 470 via drain line 430. A plumbing tee 440 is installed downstream of a valve 445 for the water supply line 435 to the toilet 470. This tee directs water to the system.

A three way valve 450 controls the flow of water to either (a) a mixing inductor 455, in which cleaner liquid 480 is drawn into the lines that supply liquid to the lower and upper nozzles 425, 460, or (b) to a drain eductor 440, in which water supplied via line 475 draws waste liquid from the receptacle 420 and propels it to the toilet 470 via drain line 430.

While an exemplary embodiment of the invention has been described, it should be apparent that modifications and variations thereto are possible, all of which fall within the true spirit and scope of the invention. With respect to the above description then, it is to be realized that the optimum relationships for the components and steps of the invention, including variations in order, form, content, function and manner of operation, are deemed readily apparent and obvious to one skilled in the art, and all equivalent relationships to those illustrated in the drawings and described in the specification are intended to be encompassed by the present invention. The above description and drawings are illustrative of modifications that can be made without departing from the present invention, the scope of which is to be limited only by the following claims. Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents are intended to fall within the scope of the invention as claimed.

What is claimed is:

1. A toilet tool cleansing system comprising:

a first housing for containing at least a substantial portion of a toilet tool, said first housing having a top end and a bottom end and including a door, the door being movable from a closed position to an open position, and in the open position the door providing a first opening in the first housing for insertion and removal of the toilet tool, and in the closed position the door covering the first opening;

at least one liquid spray nozzle in the first housing aimed at a portion of the first housing where the toilet tool is contained;

a water supply line fluidly coupled to the at least one liquid spray nozzle;

a valve in fluid communication with the water supply line, the valve controlling water supply to the at least one liquid spray nozzle a drain port in the first housing, said drain port comprising a drain eductor and said valve controlling water supply to the at least one liquid spray nozzle also controlling water supply to the drain eductor; and a drain line extending from the drain port to a toilet bowl, and said drain eductor propelling water through the drain line to the toilet bowl, the first housing being at a height below the toilet bowl.

2. The toilet tool cleansing system according to claim 1, the valve being a three way valve having an off position, a position that supplies water to the spray nozzles and a position that supplies water to the drain eductor.

3. The toilet tool cleansing system according to claim 1, the at least one liquid spray nozzle comprising a first nozzle and a second nozzle.

4. The toilet tool cleansing system according to claim 3, the at least one liquid spray nozzle comprising a first nozzle and a second nozzle, each of the first nozzle and the second nozzle being fluidly coupled to the water supply line, and the first nozzle being aimed to spray in a first direction and the second nozzle being aimed to spray in a second direction.

5. The toilet tool cleansing system according to claim 4, the first nozzle being above the second nozzle and the first direction being downwardly, and the second direction being upwardly, and at least a portion of the toilet tool being disposed between the first and second nozzle.

6. The toilet tool cleansing system according to claim 5, further comprising a ledge in the first housing adjacent to the bottom end of the first housing, the ledge supporting the toilet tool in an elevated position in the first housing above the second nozzle and below the first nozzle.

7. The toilet tool cleansing system according to claim 5, the bottom end of the first housing comprising a funnel-shaped receptacle having a conical mouth leading to a tubular outlet comprising the drain port.

8. The toilet tool cleansing system according to claim 1, further comprising a hinge attaching the door to the first housing, said door being able to pivot on the hinge from a closed position to an open position.

9. The toilet tool cleansing system according to claim 1, further comprising a liquid substance introduction eductor fluidly coupled to the water supply line and disposed between the valve and at least one liquid spray nozzle.

10. The toilet tool cleansing system according to claim 9, further comprising a liquid container removably coupled to the liquid substance eductor, said liquid container containing a liquid disinfectant, and a tube extending from the liquid substance eductor into the liquid container.

11. The toilet tool cleansing system according to claim 10, the liquid substance eductor comprising an eductor port in which water flowing through the water supply line draws in liquid disinfectant from the liquid container.

12. The toilet tool cleansing system according to claim 10, the liquid bottle being replaceable.

13. The toilet tool cleansing system according to claim 10, the liquid bottle being refillable.

14. The toilet tool cleansing system according to claim 1, the toilet tool comprising a toilet plunger.

15. The toilet tool cleansing system according to claim 1, the toilet tool comprising a toilet brush.

16. The toilet tool cleansing system according to claim 1, the first housing being at a height below the toilet bowl, the drain eductor causing flow from the drain port through the drain line to the toilet bowl.

17. The toilet tool cleansing system according to claim 16, the first housing being attached to a wall adjacent to a toilet bowl.

18. The toilet tool cleansing system according to claim 17, further comprising a toilet water supply line supplying water to the toilet bowl, the toilet tool cleansing system further comprising a coupling fluidly connecting the water supply line of the toilet tool cleansing system to the toilet water supply line.

* * * * *